US009844790B2

(12) United States Patent
Morgan et al.

(10) Patent No.: US 9,844,790 B2
(45) Date of Patent: Dec. 19, 2017

(54) SPRAY NOZZLE ASSEMBLY

(71) Applicant: Spray Nozzle Engineering PTY Limited, Mentone (AU)

(72) Inventors: Sean Morgan, Cheltenham (AU); Stuart Morgan, Cheltenham (AU)

(73) Assignee: SPRAY NOZZLE ENGINEERING PTY. LIMITED, Mentone, Victoria (AU)

( * ) Notice: Subject to any disclaimer, the term of this patent is extended or adjusted under 35 U.S.C. 154(b) by 0 days.

(21) Appl. No.: 14/708,772

(22) Filed: May 11, 2015

(65) Prior Publication Data

US 2015/0238985 A1 Aug. 27, 2015

Related U.S. Application Data

(63) Continuation of application No. 13/317,802, filed on Oct. 28, 2011, now Pat. No. 9,027,861, which is a (Continued)

(30) Foreign Application Priority Data

Apr. 22, 2008 (AU) ..... 2008902000

(51) Int. Cl.
*B05B 1/34* (2006.01)
*B05B 15/06* (2006.01)
(Continued)

(52) U.S. Cl.
CPC ..... *B05B 1/3426* (2013.01); *B05B 1/341* (2013.01); *B05B 15/00* (2013.01); *B05B 15/065* (2013.01); *B05B 1/3006* (2013.01)

(58) Field of Classification Search
CPC ..... B05B 1/341; B05B 1/3426; B05B 15/06; B05B 15/065
See application file for complete search history.

(56) References Cited

U.S. PATENT DOCUMENTS 3,746,261 A 7/1973 Kishi et al.
4,588,131 A * 5/1986 Yamamoto ..... B05B 7/0062 239/428.5
(Continued)

FOREIGN PATENT DOCUMENTS

AU 2009240783 A1 10/2009
CN 102131588 A 7/2011
WO 2009129571 A1 10/2009

OTHER PUBLICATIONS

PCT International Search Report, PCT/AU2009/000502 dated Jul. 7, 2009.
(Continued)

*Primary Examiner* — Ryan Reis
(74) *Attorney, Agent, or Firm* — TraskBritt, P.C.

(57) ABSTRACT

A wear part includes at least one wear component made from abrasion-resistant material and an upper seal groove around a central aperture on the upper face of the wear part. The upper seal groove is adapted to receive an axially compressible seal. A spray nozzle assembly includes at least one wear part made from a hard and abrasion-resistant material and a protective housing made from a strong and resilient material and having a downstream chamber adapted to receive one or more of the wear parts in releasably trapped relationship, the downstream chamber having a wall including a post defined by a slot in the downstream chamber wall either side of the post, the post including an inwardly extending protuberance at or near its end and adapted to prevent the wear part from escaping from the downstream chamber.

20 Claims, 7 Drawing Sheets

Related U.S. Application Data continuation-in-part of application No. 12/989,130, filed as application No. PCT/AU2009/000502 on Apr. 22, 2009, now Pat. No. 9,027,860.

(51) Int. Cl.
*B05B 15/00* (2006.01)
*B05B 1/30* (2006.01)

(56) References Cited

U.S. PATENT DOCUMENTS 4,611,758 A * 9/1986 Geberth, Jr. ..... B05B 15/0283 239/119
4,613,079 A 9/1986 Mains
4,666,086 A * 5/1987 Cunningham ..... B05B 1/00 239/433
5,149,546 A 9/1992 Nelson
5,271,566 A * 12/1993 Dederich ..... B05B 15/066 239/600
5,275,340 A 1/1994 Haruch
6,394,366 B1 * 5/2002 Adams ..... B05B 1/3447 239/463
6,460,344 B1 10/2002 Steinthorsson et al.
7,320,440 B2 1/2008 Prociw et al.
7,617,990 B2 * 11/2009 Huffman ..... B05B 15/0208 162/275
8,057,220 B2 11/2011 Bretz
9,027,861 B2 5/2015 Morgan et al.
2004/0134670 A1 7/2004 Orr et al.
2008/0217435 A1 * 9/2008 Whittaker ..... B05B 1/00 239/468
2011/0036931 A1 2/2011 Morgan et al.

OTHER PUBLICATIONS

BETE® Spray Dry Manual, copyright by BETE Fog Nozzle, Inc. 2005 (25 pages).
STIHL®-SG-51-71 Owners Instruction Manual, copyright by Andreas Stihl AG & Co., KG, 2015 (44 pages).

* cited by examiner

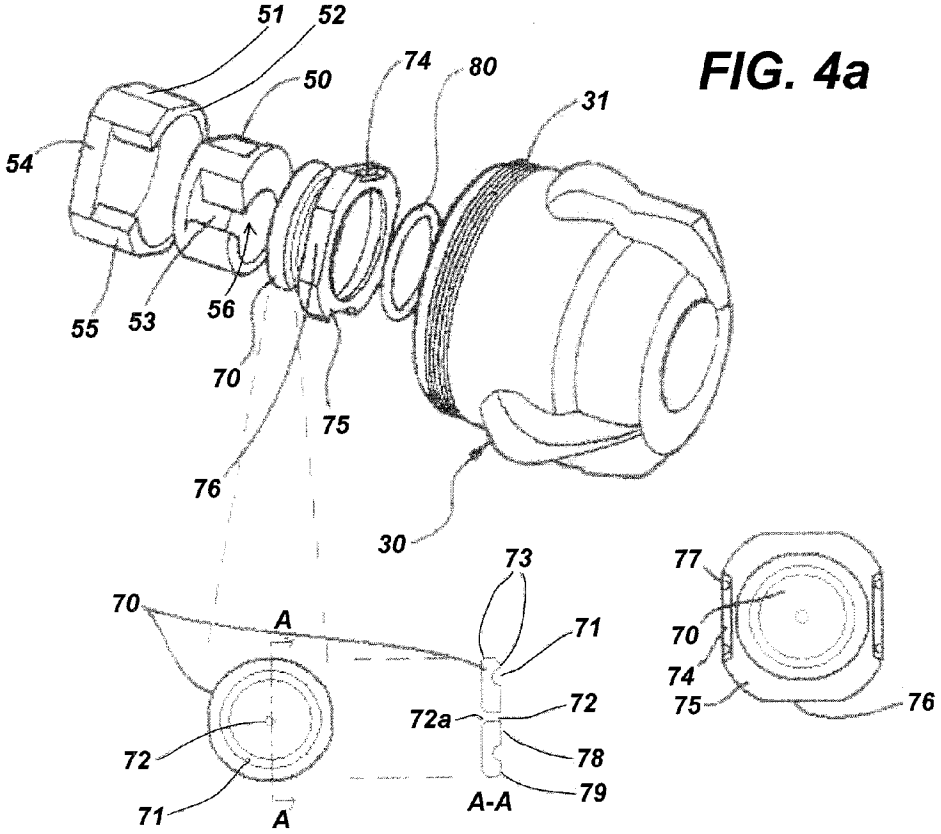
FIG. 4a
FIG. 4b
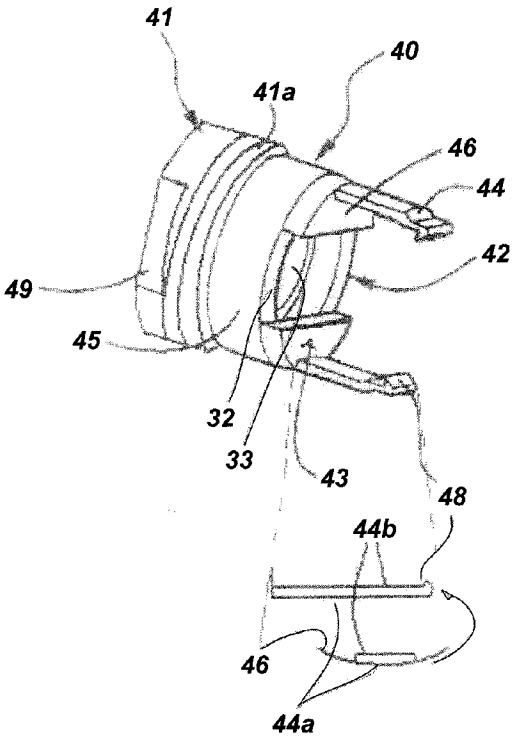
FIG. 3

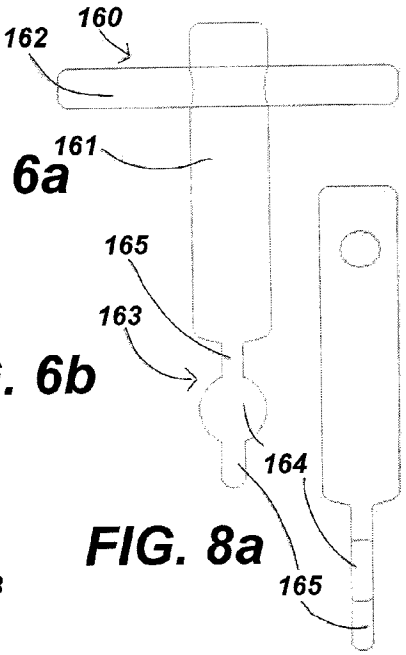
FIG. 6a
FIG. 6b
FIG. 8a
FIG. 8b
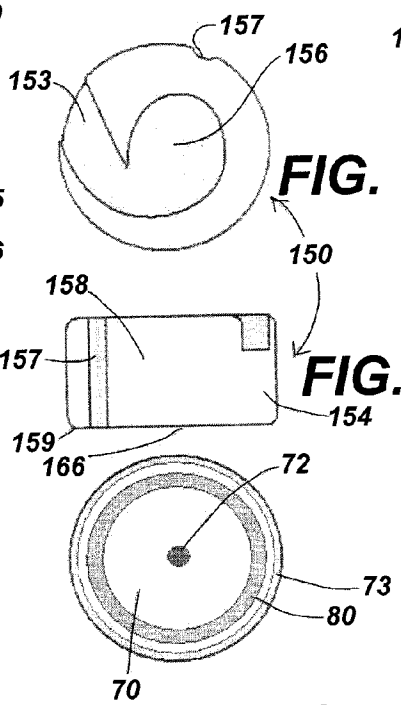
FIG. 6c
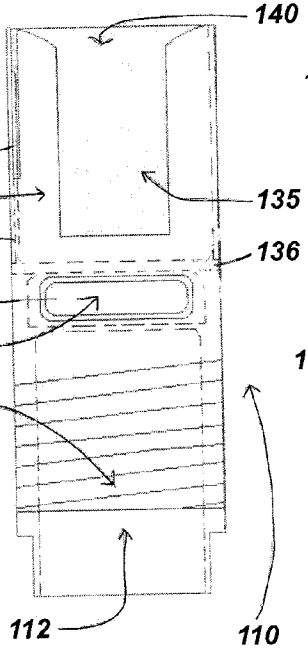
FIG. 5b
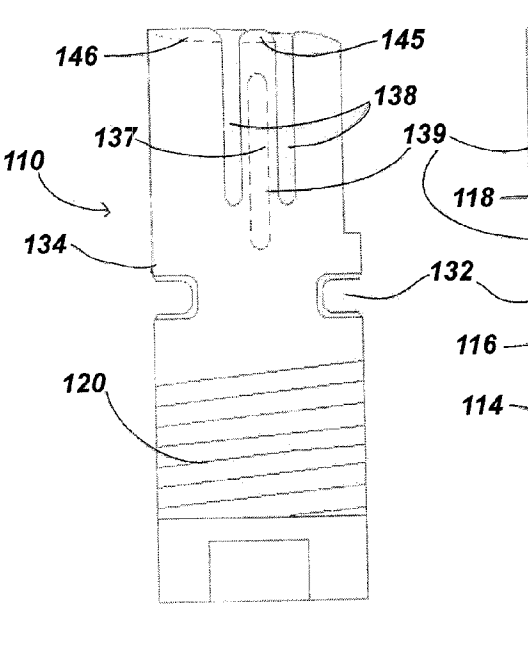
FIG. 5a FIG. 9a
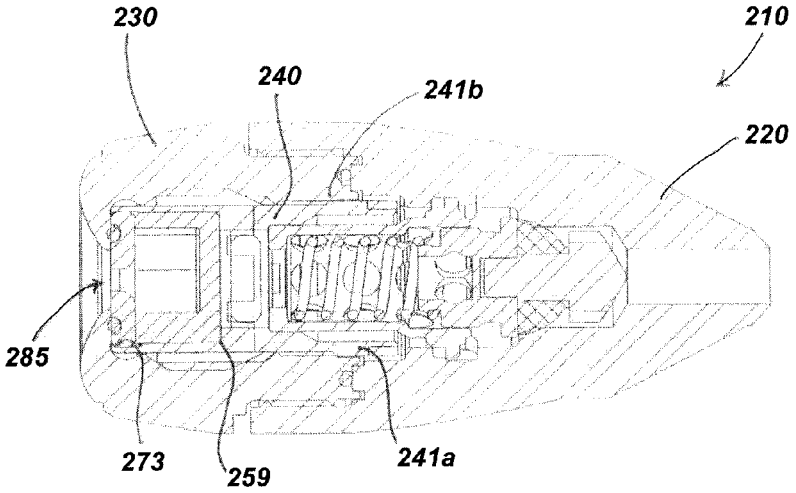
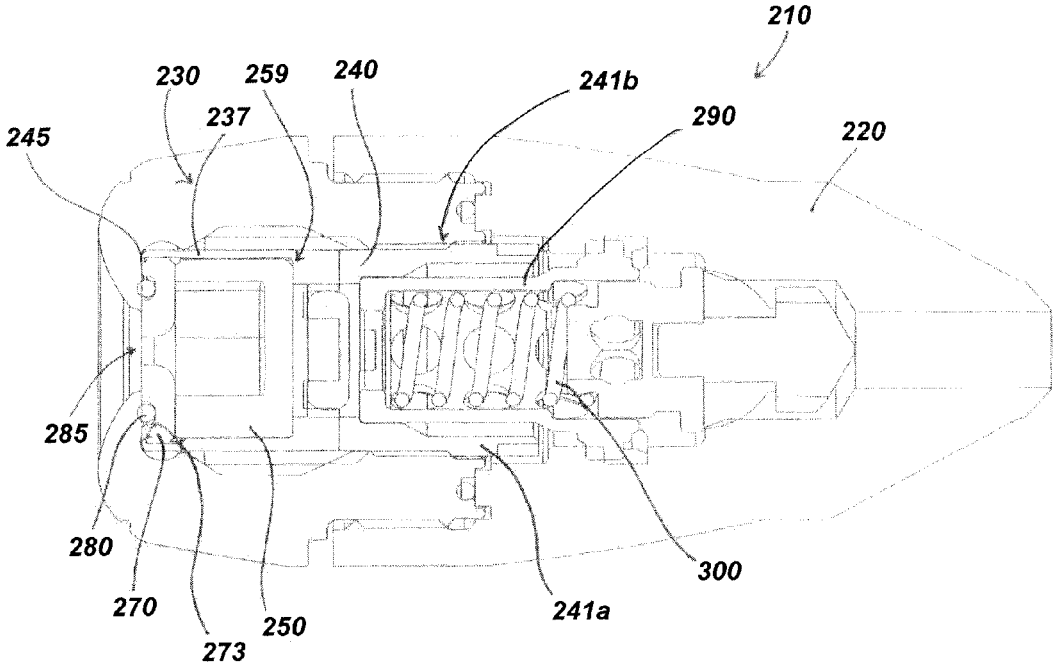
FIG. 9b

SPRAY NOZZLE ASSEMBLY

CROSS-REFERENCE TO RELATED APPLICATIONS

This application is a continuation of U.S. patent application Ser. No. 13/317,802, filed Oct. 28, 2011, which will issue as U.S. Pat. No. 9,027,861 on May 12, 2015, which application is a continuation-in-part of U.S. patent application Ser. No. 12/989,130, filed Oct. 22, 2010, which is a national phase entry under 35 U.S.C. §371 of International Patent Application PCT/AU09/00502 filed Apr. 22, 2009, published in English as International Publication WO 2009/129571 A1 on Oct. 29, 2009, which claims the benefit under Article 8 to Australian Patent Application Serial No. 2008902000 filed Apr. 22, 2008, the entire contents of each of which are incorporated herein by reference.

FIELD

This invention relates in general to spray nozzle assemblies and, in particular, to the type of spray nozzle having a check valve that is specifically adapted to be used with spray drying nozzles, but could also be used in association with other nozzles.

BACKGROUND

The following references to and descriptions of prior proposals or products are not intended to be, and are not to be construed as, statements or admissions of common general knowledge in the art. In particular, the following prior art discussion does not relate to what is commonly or well known by the person skilled in the art, but assists in the understanding of the inventive step of the present invention of which the identification of pertinent prior art proposals is but one part.

For ease of description, we shall refer to such a spray nozzle assembly in terms of one associated with spray drying of milk.

In general, spray nozzles that are provided with swirl chambers and orifice discs have these components manufactured from tungsten carbide or the like, which is very hard, but also brittle and prone to damage when dropped or otherwise roughly treated during assembly and disassembly.

When ordinary spray nozzles are used for spray drying milk, a certain percentage of the liquid simply falls as drops from the nozzles, without being atomized, and this material can well lead to spoiling of the product.

To avoid this problem, a unitary check valve was developed for spray drying nozzles, and other nozzles, which caused little restriction in the flow through the nozzle and which, at the same time, did not have any parts, or break-off parts thereof, likely to be passed into the fluid stream.

Conventional check valves, however, have sealing problems when operated at high pressures and are not necessarily as compact as would be desirable.

Prior art nozzles generally have stepped annular shoulders that ensure coaxial alignment and concentricity of respective, axially aligned wear parts. However, because the flow material (like proteinous milk products) can set or dry to a viscous or glue-like consistency, it is necessary to build in clearance gaps including radial gaps (lateral gaps to the side of the wear parts) or axial gaps (longitudinal gaps between the wear parts and the nozzle components axially containing them). These gaps between the wear parts and the nozzle cylinder need to provide sufficient play or movability of the respective parts relative to each other to facilitate removal for replacement, cleaning and repair. Also, normal manufacturing tolerances dictate a gap requirement to prevent component jams axially and radially. Therefore, the prior art designs inherently lack accurate concentricity, which has adverse affects on spray nozzle performance, predictability of spay patterns and/or spray line production. Stepped annular shoulders in the internal wall of the nozzle cap mean prior art caps are structurally weak and introduce stress concentrations at the sharp angled corners within these steps.

DISCLOSURE

It is an object of the invention to ameliorate the above problems associated with spray nozzles and particularly those used in association with check valves, and to provide general improvements in the assembly and construction of spray nozzle components.

The invention in one aspect provides one or more housings within a spray nozzle assembly for protecting one or more wear components, such as the swirl chamber and orifice disc, from damage.

It is preferred that the housing is manufactured from a durable material such as stainless steel. However, any appropriate material is included within the scope of the invention.

In another aspect of the invention, there is provided a spray nozzle assembly including at least one wear part made from a hard and abrasion-resistant material and a protective housing made from a strong and resilient material and having a downstream chamber adapted to receive one or more of the wear parts in releasably trapped relationship, the downstream chamber having a wall including an arm or post adjacent at least one slot in the downstream chamber wall, the post including an protuberance extending inwardly towards the center of the housing, the protuberance at or near the end of the arm or post and adapted to prevent the wear part from escaping from the downstream chamber.

Hereinafter, reference to the post will include reference to the arm or post.

The housing and the downstream chamber are preferably generally cylindrical, but may include a number of symmetrical or irregular cross-sectional shapes, particularly to prevent axial rotation of the wear parts. The downstream chamber is preferably open-ended.

The housing may be a generally hollow cylinder. The housing may have shoulders for seating the wear parts.

Preferably, the present housing provides tapered seats for wear parts and the wear parts have complementary annular tapered or beveled edges. The tapering of the edges and corners enables the wear parts to cooperate with the housing seats to achieve self-alignment and concentricity as the parts are axially compressed into axial alignment on assembly. The wear parts naturally coaxially align with the housing and, as they are axially compressed in the housing, they align in fixed concentric and coaxial alignment. This arrangement provides for accurate alignment of orifices, apertures and openings for maximum efficiency and predictability of flow and spray characteristics. Concentricity is achieved by providing tapered surfaces, such as angular, radiused, curved, chamfered or beveled surfaces, over short axial or longitudinal distances, whereas prior art arrangements provided large longitudinal sections to locate parts axially. Concentricity is achieved via angular-type interfaces over a short distance, rather than the longer longitudinally radial location of the prior art steps, thus reducing adhesion surfaces at points or concentricity, which determine concentricity of the wear parts. One could provide shorter longitudinally aligned radial walls, but still need gaps to prevent adhesion. Full concentricity may be achieved only once the housing is compressed by an axial load in the cap to achieve full alignment. The tapered surfaces may be identical in angle or the tapered surfaces may be different, for example, concentricity may be provided thus:

Radius to radius

Radius into taper engagement about a radius

Parallel taper-to-taper engagement

Varying taper angular point engagement

This provides a multiple step alignment: the clasp first aligns, followed by axial compression via an O-ring concentrically arranged in the top surface of an orifice disk, which forces the lower tapered surfaces into alignment. Concentricity is, therefore, achieved via an angular type interface over a short distance, rather than the longer longitudinally aligned radial location of the steps, thus reducing adhesion surface at points that determine concentricity of the wear parts.

Another aspect of the invention is that the nozzle component parts are screw fitted for axial engagement. This provides a particular functional advantage over other wear part installations that are not screw fitted, because in prior versions, a certain amount of longitudinal radial gap is required to enable removal and replacement of wear parts to be facilitated. In the present arrangement, the wear parts enclosed in the housing are compressed into a tightly fitting axial alignment. Prior art arrangements require an arbor press, such as a manually levered mandrel press, to disengage thickly bound parts glued together by sticky, viscous or dried materials. The axial screw engagement of the housing to the nozzle component, such as the nozzle cap, assists concentricity of the component parts, achieves a tight-fitting arrangement for better flow and predictability of spray properties, and provides an in-built arbor press or means to apply high torque to the component parts to break the adhesion caused by the dried material and enable replacement of the parts. The internal wall of the nozzle cap includes an annular guide to keep the housing wall and the post radially inwardly supported against flexing until the housing is partially removed from the nozzle cap. The internal wall of the nozzle cap includes an annular stress-relieving radiused recess. The bottom edge of the recess forms a radially inward clasp or grip retention diameter or annular guide to stop the post, arms or claws 145 from releasing grip of the wear parts until the "glue" is broken and the housing has been at least partially removed from the nozzle cap.

Moreover, the protective housing extends the life of the wear parts considerably. Excessive eccentricity affects a spray nozzle's performance. The geometry is off center, making a nozzle less efficient and requiring greater pressure of the flow material to deliver adequate flow of the product through the nozzle vortex, including the swirl chamber and the cavities defined by the nozzle.

Because concentricity of the component parts is achieved, the nozzle barrel components, such as the nozzle cap, may be engineered differently to avoid the sharp angles required in the prior art to achieve concentricity and the nozzle cap structures are not required to achieve alignment of the housing or wear parts. The nozzle head internal structures close to the orifice may be radiused in profile to minimize the concentration of stress areas or points associated with sharp edges by distributing the stress load over a wider surface area of the radiused or curved annular concave structure.

The wear part may include an orifice disc and/or a swirl chamber. The wear parts may be seated, trapped, fixed or otherwise located in the downstream chamber. The swirl chamber may be adjacent the orifice disc, which is preferably aligned axially therewith. The orifice disc may be sized to be trapped immediately under the retaining edge or protuberance.

The post is preferably resiliently deflectable to permit the wear part to enter or be removed from the downstream chamber upon application of sufficient force, but be retained against axial displacement at rest. The base of the post may be located intermediate the height of the chamber wall or may extend down to the base.

A longitudinally aligned key may extend along part or all of the length of the chamber wall. The key preferably cooperates with a complementary feature on the side wall of the wear part to prevent the wear part, particularly the swirl chamber, from rotating axially in the downstream chamber. The key advantageously provides structural reinforcement of the post and may extend beyond the post along the inside chamber wall down to or toward the base.

The complementary feature may be a longitudinally aligned groove. The key may be one or more protrusions protruding from the inner surface of the post toward the axial center of the downstream chamber and aligned longitudinally and parallel to the chamber axis. The key is preferably a ridge. The ridge may extend the full length of the post and down to a base of the downstream chamber.

The downstream chamber base may be an annular ledge or circumferentially spaced radially inwardly extending protrusions or any other seat device that prevents axial displacement of the wear part away from the retaining edge or protuberance to below the seat device within the housing. The top surface of the outer surface of the top of the post 137 and the inner chamber wall may be a radius-to-radius engagement or abutment relationship.

The chamber wall may include a side opening. The side opening may define one side of the post. However, to protect the post, the post may be defined by a slot either side of the post. The chamber wall may extend further to the opening from a slot adjacent the arm or post. The side opening may register with a mouth of a cavity of the swirl chamber. The side opening may provide flow communication between an intermediate chamber 114 of the housing 110 and the swirl chamber 150 via the cavity of the nozzle encompassing the housing.

The housing may include a wall having at least one opening, such as a slot, providing access to the intermediate chamber below the downstream chamber. The slot may be accessed by a cam tool. The cam tool may have a disc cam intermediate a shaft to enable the disc cam to be rotated and to bear against the one or more wear parts. The cam may overcome a retaining force of the protuberance by urging the wear part to bear against the retaining edge, thereby deflecting the post to allow the at least one wear part to be removed. The slot preferably provides flow communication between a lower chamber and the intermediate chamber.

It is further preferred that the orifice disc and the swirl chamber be retained in one or more housings by means of a peened or machined retaining edge about its periphery, thus making these parts and respective housing a unitary assembly. The retaining edge preferably extends radially inwardly.

The invention in a second aspect provides a clasp device used to locate and secure the swirl chamber and orifice disc components within the spray nozzle retainer cap.

The arrangement is such that the wear parts and housings clip in to the clasp device in which they are retained by means of the arm members. The precise means whereby this is effected is not restricted in the invention. A preferred means, however, is the engagement of the terminal ends of the arms with corresponding lugs on the engaging flats of the wear parts.

The invention in a third aspect is the provision within a spray nozzle assembly of a first O-ring that seats within a lance adapter and is held compressively by the retainer cap when assembled and a second O-ring within the retainer cap that compressively seals under the load applied by a clasp used to locate the swirl chamber and orifice disc components.

The arrangement is such that each O-ring is compressed independently of the other.

Previously, such sealing had been effected by means of flat washers or axial gland seals, both of these being less effective at high pressures. This could be partially addressed with support backup rings, however, these are difficult to install on a regular basis and expensive to replace and have limitations at elevated pressures. The use of the O-rings as described here addresses these problems and are highly effective in such a static arrangement at much higher pressure levels than previously possible.

In a further aspect of the invention, wear parts in a spray nozzle are provided with durable housings into which they are located.

It is preferred that these housings be applied to parts such as swirl chambers and orifice discs.

In a further embodiment of the invention, a swirl chamber or orifice plate can be provided that is smaller in diameter than that which would be conventionally used such that, when a housing is applied about their peripheries, the resulting diameter of each is then that of such conventional devices.

It is, therefore, preferred that these be able to be retrofitted to existing spray nozzle assemblies.

In an embodiment of the invention in which a check valve is included, the perforated sleeve covering the valve is provided with locating pins positioned at the end of the sleeve furthest from the nozzle in order to minimize the length of the spray nozzle assembly.

The invention in a fourth aspect provides a threaded end on the retainer cap that engages with an internal thread in the lance adapter, such that no exterior threads are provided on the assembled spray nozzle assembly and as such, damage to external threads cannot occur.

BRIEF DESCRIPTION OF THE DRAWINGS

Possible and preferred features of the present invention will now be described with particular reference to the accompanying drawings. However, it is to be understood that the features illustrated in and described with reference to the drawings are not to be construed as limiting on the scope of the invention. In the drawings:

FIG. 3 is a perspective view of a component of the clasp device shown in FIG. 1 with an arm member shown from additional partial side and top plan perspectives;

FIG. 4*a* is an exploded perspective view of part of the assembly shown in FIG. 1 with the orifice disc shown from top plan and side perspectives;

FIG. 4*b* is a top plan view of an orifice disc shown in FIG. 4*a* in its housing;

FIG. 5*a* is a side view of a cylindrical housing according to a second embodiment of the invention;

FIG. 5*b* is another side view of the cylindrical housing shown in FIG. 5*a* rotated about 90 degrees;

FIG. 6*a* is a top plan view of a swirl chamber according to the second embodiment;

FIG. 6*b* is a side view of the swirl chamber shown in FIG. 6*a;*

FIG. 6*c* is a top plan view of an orifice disc according to the second embodiment;

FIG. 8*a* is a front elevation of a cam tool according to the second embodiment;

FIG. 8*b* is a side elevation of the cam tool shown in FIG. 8*a;*

FIGS. 9*a* and 9*b* are cross-sectional views of a spray nozzle made according to a third embodiment similar to the second embodiment;

DETAILED DESCRIPTION

Figure 1:
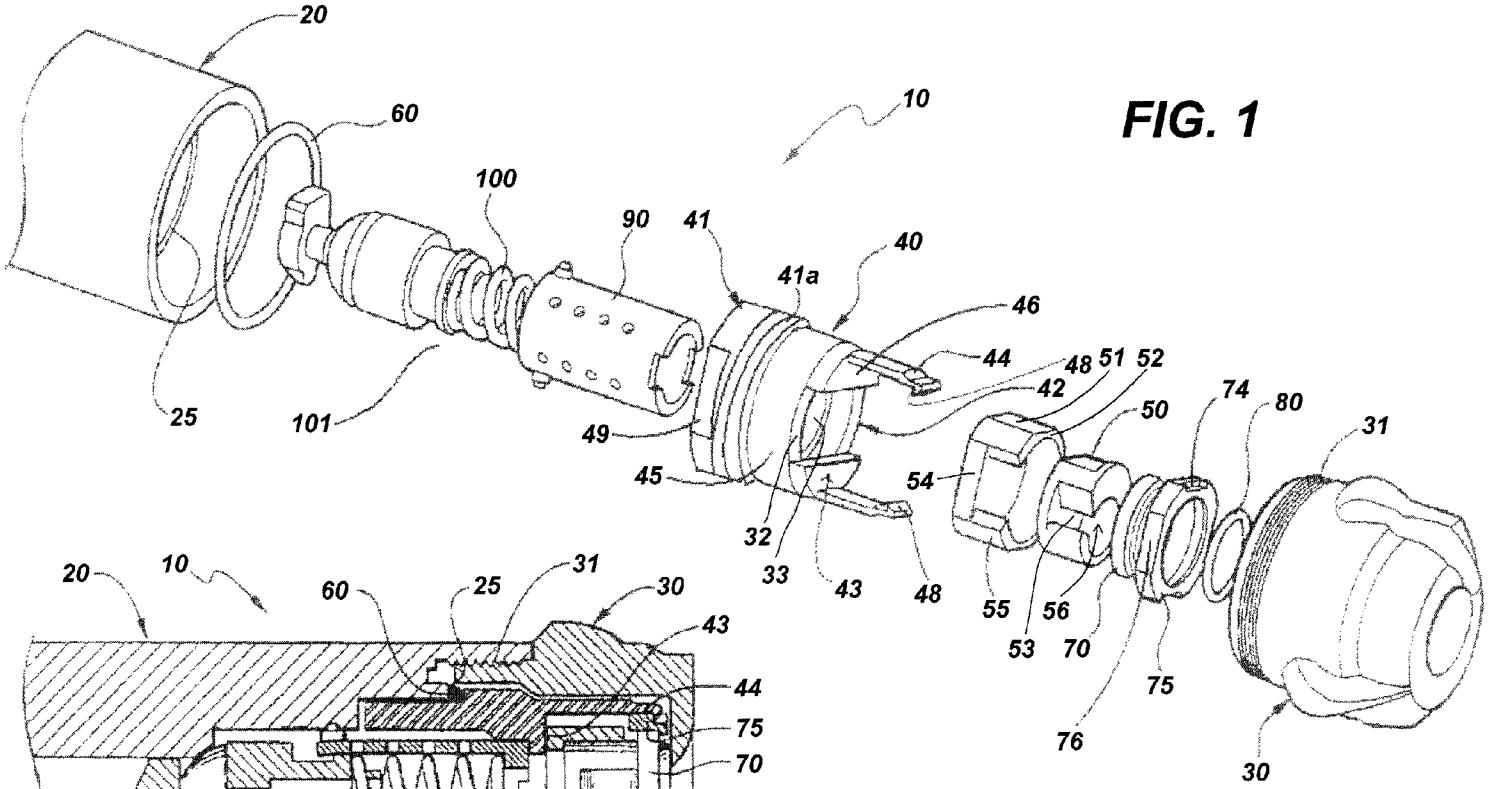
FIG. 1 shows an exploded diagram of the components of a first aspect of the invention.

In a first embodiment, a spray nozzle 10 is shown in FIGS. 1 through 4, including a lance adapter 20 and retainer cap 30 components, with a spring valve 101, a clasp device 40 and swirl chamber 50.

The clasp device 40 has a first end, corresponding to a clasp base 41, seats compressively against an O-ring 60 located against an annular shoulder 25 in sealing arrangement within the generally cylindrical lance adapter 20.

The clasp device 40 comprises a generally cylindrical body 45, extending rearward to the concentric base 41 that is generally concentric therewith and narrower in diameter, having an annular step down to the base 41. An opposing end of the cylinder 45 has a seat 43 for a swirl chamber 50 and orifice disc 70 assembly. The seat 43 comprises a pair of opposed raised co-planar partial discs 46 that define therebetween a broad aperture 42 with parallel straight sides and radiused ends following the contours of the radiused forward end walls of the cylinder body 45. The clasp 40 further includes arm members 44, which each comprise an elongate arm 47, that have a radiused or arced outer surface in cross-section following the contour of the cylinder body 45 and an internal planar surface that cooperates with a corresponding pair of opposed flats 51 extending the full length of the housing 55 outer body. The arms 47 of the arm members 44 each terminate in a shallow radially inwardly extending hook 48 that is adapted to clamp or pass over the upper edge 52 of the opposed flats 51 of the housing 55, thereby preventing rotation of the housing 55 and importantly, therefore, the swirl chamber 50, within the cylindrical body 45. Limitation of rotation of the wear parts 50, 70 minimizes wear and enables the design of a predictable flow path and consistency of flow. Prior art swirl chambers have traditionally been cylindrical and permitted rotation within the cap.

The swirl chamber 50 characteristically has an entrance 53 defining a converging pathway into the cavity 56 of the swirl chamber 50. A flat wall 54 of the housing 55 immediately below the entrance 53 allows a sufficient gap between it and the upper wall of the cylindrical body 45 to allow good flow communication between the central bore 33 of the cylindrical body 45 and cavity 56 via a gap 32 defined by the cylindrical body 45 and the lower edge of the flat wall 54. The housings 55, 75 are loosely fitted within the clasp arms 44 to permit some slack, allow high tolerances and primarily to facilitate the removal of the wear parts after use has gummed them up with the cementitious or gluey flow material.

The orifice disc 70 compressively abuts an O-ring 80 against and with the retainer cap 30. This provides an excellent seal between the orifice disc 70 and the retainer cap 30 because the O-ring 80 is captured in an upwardly facing circular groove 71 concentrically set in the upper face of the orifice disc 70. The compression of the O-ring 80, rather than using a traditional annular seal, significantly improves seal performance, longevity and wear resistance, and improves the tightness of the fit of the relative components. In this high-wear application, the compressive seal arrangement is advantageous.

In FIGS. 3*a* and 3*b*, the profiles of the clasp arms 44 are shown. In FIG. 3*a*, the clasp arms are shown to have a flat internal wall 44*b*, which cooperates with the pair of flat walls 51 of the housing 55 to prevent rotation of the housing 55 about the longitudinal axis of the clasp device 40.

During use of such a spray nozzle 10, it is common for the material being sprayed to adhere to the contacting components. Wear parts that are exposed to the high abrasion and pressure of the flowable material are ideally made from costly, extremely hard and abrasion-resistant materials, preferably Tungsten-carbide or the more rudimentary iron-carbon steels. However, because of their hardness, such materials are generally brittle, lacking in strength. Therefore, advantageously, the wear parts 50, 70 of the present invention are separately formed using extremely hard materials, and then encased or pressed into tightly fitting cases, shrouds or housings 55, 75 made of stronger and more workable materials, such as 300 series stainless steel. Moreover, with the device 10 of the invention, the provision of the clasp 40 permits wear parts 50, 70 to be simply removed. The clasp device 40 has a threaded outer surface 41*a* on its base 41 above a pair of opposed flats 49, which facilitate its removal by rotation using a suitable spanner, the threads 41*a* of the clasp base 41. Upon rotation of the clasp 40 relative to the retainer cap 30, damage to the wear parts is avoided that is caused by the conventional pressing out of the wear parts by an arbor press or other such means.

The swirl chamber 50 is located within the housing 55 made of stainless steel to provide a strong swirl chamber assembly with a strong outer casing but hard internal wear surfaces. Similarly, the orifice disc 70 is surrounded by the stainless steel housing 75, which protects it from any damage that might otherwise result from dropping or handling during assembly and disassembly.

The swirl chamber and the orifice disc are retained in their housings as unitary devices by the peening or machining of a peripheral edge of each housing over these devices. Of course, other means of providing an annular inwardly radially extending flange or lip known to the skilled person can achieve satisfactory trapping or encasing of the hard wear item 50, 70 in the respective housing casing 55, 75.

These wear items 50, 70 are manufactured typically from tungsten carbide, which is relatively expensive and brittle. However, they permit the production of a narrower, more accurate orifice 72 and greater precision in machining and other working of the material. By providing smaller diameter orifice discs 70 and swirl chambers 55, expense is spared because less material is used in their manufacture, as well as the devices 50, 70 being protected from damage by their stainless steel housings 55, 75. Pressing the wear items 50, 70 into their housings 55, 75 by peening or machining has proved efficacious and has overcome problems of relative movement of these components 50, 70, 55, 75, which is problematic in this high-pressure, high-wear application where components out of alignment adversely affect performance and the duration between forced replacement of consumable products 50, 70, 55, 75. This may be distinguished with the relative looseness of the fit of the consumables 50, 70, 55, 75 in the clasp device 40, which permits some axial movement to facilitate removal and replacement.

It is also envisaged that these wear items 50, 70 be provided in situ in their housings 55, 75 at the same size as such conventional items that also permit them to be retrofitted to existing spray nozzle assemblies and used as wear part consumables therein.

With reference to FIGS. 4*a* through 4*c*, there is shown the orifice disc 70 and housing 75 in greater detail. The orifice disc 70 is a circular thin disc shape that is 1 mm to 2 mm in height and about 14 mm to 20 mm in diameter, but noting that these dimensions are merely suggestive and the invention is not limited to orifices having particular dimensions. On the sides of the housing 75 corresponding to the position where the clasp hook 48 overhangs the housing 75, the housing 75 has opposed flat sides with a recessed section 74 having a narrow and shallow ledge inclining upwardly toward the orifice 72. The recess 74 provides a resting position in which the hook 48 is adapted to nest and includes a pair of spaced knobs or small ramps 77, one at each end of the recess 74, that laterally retain the hook, overhang or catch 48 and provides a ramp over which the ends of the hook 48 may ride on insertion or removal, noting that there is some play purposely incorporated in the fit of the component parts 40, 44, 55, 75.

The orifice 72 is centrally located in the orifice disc 70. Concentrically placed around the periphery of the disc 70 on its upper surface is a circular groove 71 adapted to receive an O-ring 80 as previously described. The groove is sufficiently deep to retain the O-ring 80, but sufficiently shallow to allow the O-ring 80 to sit partially proud of the upper disc 70 surface. The orifice 72 is finely machined or otherwise formed to low tolerance, which is made possible by the use of hard and workable alloys. The orifice 72 has a flare mouth or inlet 72*a* located centrally on the orifice's 70 underside surface to facilitate pressurized flow into and through the orifice 72. Different applications will require different sized apertures for the orifice 72.

The orifice disc upper surface 78 includes an annular peripheral beveled or cammed edge 79 over which the upper inner walls of the housing 75 are peened or worked to provide a smooth transitional surface from the housing upper peripheral surface to that of the orifice disc 70 and ensure a good mating relationship. The lower side walls are similarly beveled or radiused to facilitate peening or working of an inward extending radial flange of the housings 55, 75 to extend over the upper and lower peripheries of the orifice disc 70.

Although the materials described are preferred, they are not restricted in the invention.

Figure 2:
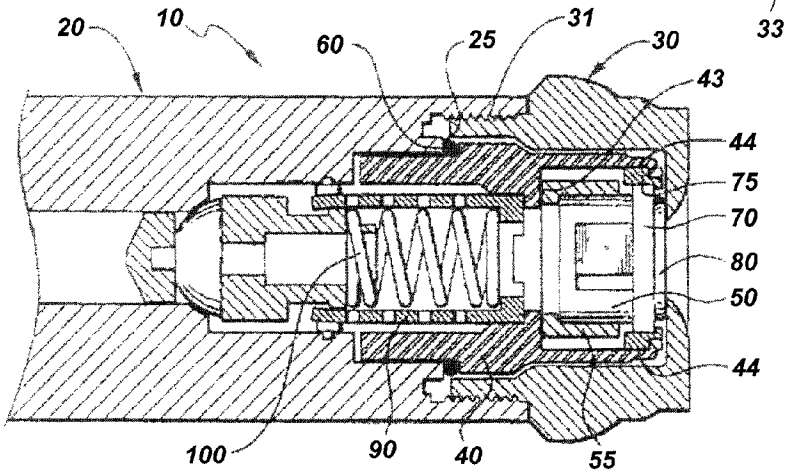
FIG. 2 shows an assembled cross-sectional view of the nozzle assembly shown in FIG. 1.
Figure 7:
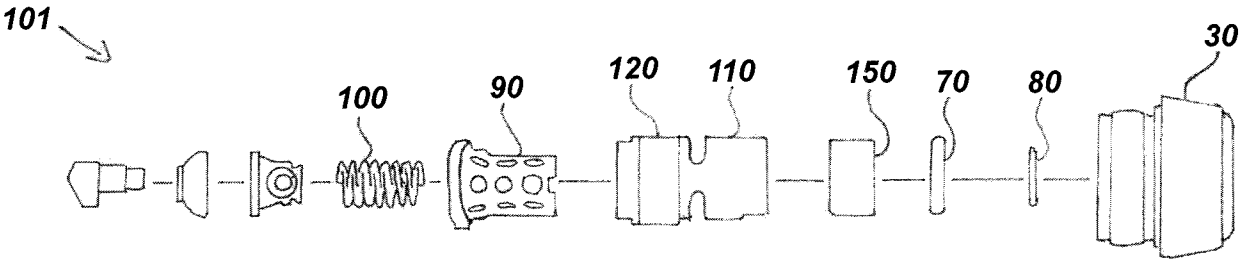
FIG. 7 is an exploded view of a spray nozzle assembly according to the second embodiment.

In a second aspect of the invention shown in FIG. 2, a check valve is provided within the spray nozzle assembly. In this embodiment, the first end 41 of the clasp passes generally over the perforated sleeve 90 covering the valve spring 100. This first end of the clasp in turn seats compressively against an O-ring 60 located against a shoulder 25 within the lance adapter 20 to form a seal.

The lance adapter 20 and end cap 30 engage by means of a screw thread 31 located within one end of the lance adapter and the exterior of one end of the end cap, the arrangement being such that when screw connection of these components has been effected, no external thread is present that could be damaged by contact.

Another embodiment of the inventive clasp arrangement is shown in FIGS. 5*a* through 6*c*, a smaller (so-called "mini") spray nozzle arrangement compared to the "maxi" embodiments shown in FIGS. 1 and 3 through 4*c*.

In FIGS. 5*a* and 5*b* there is shown a substantially cylindrical protective shell or casing in the form of a housing 110 having a central bore 112 that is axially continuous through lower, intermediate and upper chambers 114, 116, and 118. The lowermost chamber 114 is the inlet for the clasp arrangement and receives incoming flow material into the nozzle. The lower outer surface of the housing 110 includes a threaded portion 120 that is adapted to engage the internal thread in a nozzle cap 30. Similar to the valve arrangement 101 shown in FIG. 2, the lower chamber 114 receives the perforated sleeve 90 of valve 101 and telescopically the other valve 101 components, including the spring 100.

The arrangement includes a swirl chamber 150 that may be identical to that shown in FIGS. 1 and 2, or may be dimensioned differently to give the chamber 150 different characteristics of atomization and spray pattern, velocity of spray and density of application, etc. The swirl cavity 156 in this case is very shallow and the broad wall 154 immediately below the mouth 53 is high, relative to the broad wall 54 of the housing 55 in FIG. 1.

However, the swirl chamber 150 further includes a longitudinal groove key 157 machined or otherwise formed the full height of the predominantly cylindrical wall 158 of the swirl chamber 150. The groove key 157 provides a lock on axial rotation of the swirl chamber 150 when housed in the cylindrical housing 110. The orifice disc 70 may be identical to that shown in FIG. 1 or may be varied with respect to the orifice size 72. There is bulk economy in providing swirl chambers 150 and orifice discs 70 of identical outer dimensions so that one size fits all arrangements. The orifice disc 70 is shown in FIG. 6*c* with the O-ring 80 seated in the circular groove 71.

The invention enables the same sized swirl chambers 150 and orifice discs 70 to be used in spray nozzles 10 of different sizes and capacities, such as mini and maxi spray nozzles, while advantageously protecting wear parts 50, 70, 150 made from hard and correspondingly brittle materials with housings 55, 75, 110 made from strong and resilient materials, irrespective of the spray nozzle bore sizes in the cap 30 and lance adapter 20.

The cylindrical housing 110 is adapted to house both the swirl chambers 150 and orifice discs 70 in axial relationship in the chamber 118 in a snug fit but allowing a small amount of play to facilitate removal and replacement of the consumable wear parts 70, 150 when gummed up by dried flowed material, such as proteinous milk.

The flow path from the lance adaptor 20 through to the central bore 112 occurs through a pair of opposed large slots 132 formed in the cylindrical wall 134, which provide the entrance for the flow material into the intermediate chamber 116.

Immediately above the intermediate chamber 116 is an annular ledge providing a seat on which the swirl chamber 150 may rest when inserted into the upper chamber 118. The cylindrical wall 134 includes a large generally rectangular opening 136 that is adapted to be in registration with the cavity mouth 153 of the swirl chamber 150.

Circumferential registration of the swirl chamber 150 is achieved by providing a registration arm or post 137 defined by two spaced longitudinal slots 138 in the wall 134, the post 137 having a key ridge 139 extending down a substantial portion of its length on the post's 137 inside surface.

The ridge may be two or more longitudinally aligned protrusions, but is preferably a continuous ridge starting immediately underneath the position that the orifice disc 70 takes up above the swirl chamber 150 in the upper chamber 118 to ensure that a standard circular disc 70 may be used, and depending down to the ledge 135. The cylindrical housing 110 includes an open top 140 through which the swirl chamber 150 is first axially inserted by an operator, its beveled peripheral lower edge 159 assisting the lower edge's 159 passage past the upper end of the post, which includes a shallow detent, clasp, catch or stop 141 comprising a protrusion extending radially inwardly to trap the orifice disc 70 in place once inserted after the swirl chamber 150. The post 137 is resiliently deflectable radially outwardly due to its narrow width, despite the strengthening properties of the ridge 137, so that the orifice disc 70 may ride past the catch 145 and nest in the very top of the upper chamber 118. The catch 145 forms part of a radially inwardly extending lip 146 that continues along the inner upper surface of the cylindrical wall 134 and gradually tapers off. The cylindrical shape of the orifice disc 70, albeit shallow as it is and its tight axial fit in the downstream or upper chamber 118, means that it is difficult to tilt out of axial alignment and is so held by the nonsymmetrical detent 145 on one side of the upper chamber 118.

Once the spray nozzle has been used and the wear parts 70, 150 need replacing, the nozzle cap 30 and housing 110 are unthreaded from the lance adapter 20 and cap 30, respectively. A special cam tool 160 may be used to lever the wear parts 70, 150 out of the housing 110 when required. The cam tool includes a central shaft and a crucifix handle 162 for manipulating the tool 160. The remote end of the shaft 161 terminates in a cam device comprising a cam disc 164 intermediate a spindle 165. In use, the cam device 163 is inserted into one of the large slots 132 and through to the opposed slot 132, so that the cam disc 134 is located immediately underneath the swirl chamber 150 with the cam disc substantially in alignment with the slots 132. On rotation of the tool 160, the cam disc 163, supported by the spindle 165 bearing against the lower edges of the slots 132, rides up against the underside 166 of the swirl chamber 150, whereby to apply upward force against the swirl chamber 150 so that the orifice disc 70 is forced passed the catch 145 and out of the upper chamber 118.

Figure 10:
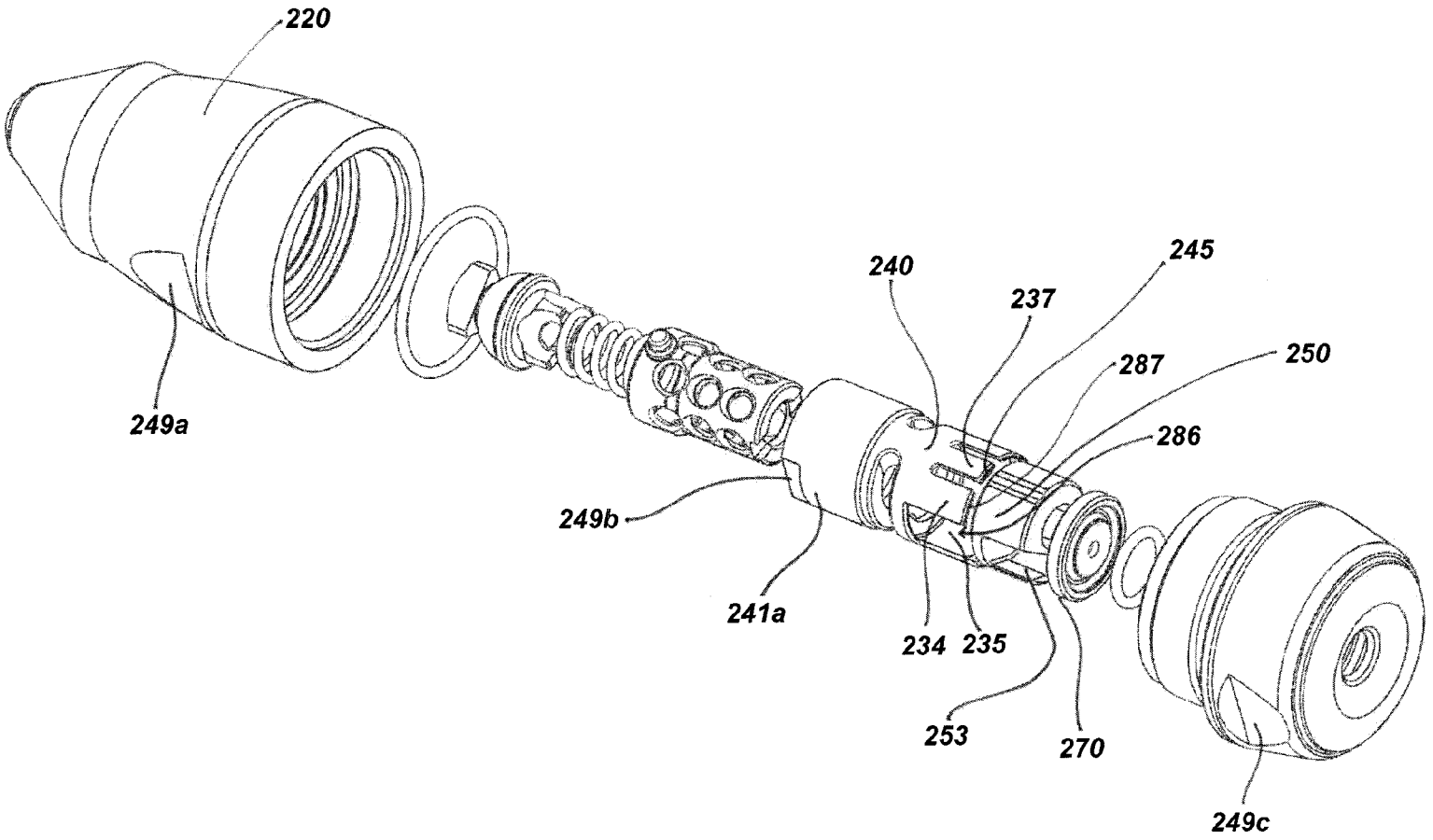
FIG. 10 is an exploded perspective view of the spray nozzle made according to the third embodiment.

Turning to FIGS. 9*a* through 10, there is shown an assembled nozzle 210 similar to the second embodiment shown in FIGS. 5*a* through 8*b*. The nozzle 210 includes a nozzle cap 230 threadably engaged to a lance adapter 220. The nozzle 210 includes a wear parts housing 240 threadably engaged to the nozzle cap 230 by an outer threaded surface 241*a* of the housing 240 engaging an internally threaded bore 241*b* in the nozzle cap 230. The housing 240 traps the wear parts, a swirl chamber 250 and an orifice disc 270, in concentric relationship by providing a self-aligning combination of beveled or tapered edges 259 and 273 that cooperate with similarly tapered annular surfaces within the housing 240 to ensure that as the orifice disc 270 is pressed past the claw 245 at the top of the arm 237, the respective tapered surfaces of the wear parts 250, 270 and the internal surfaces of the housing 240, cooperate to concentrically align part in the housing 240 in a fixed arrangement with minimal play between the wear parts 250, 270 and the housing 240.

The provision of an axially compressed seal 280 in the upper surface 278 of the orifice disc 270 enhances the axial alignment and compression of the various parts 250, 270, 240 in the cavity defined between the nozzle cap 230 and the lance adapter 220. Whereas a radial O-ring might fail and be forced through the orifice 285, the compression seal 280 is much less likely to fail and its effectiveness is improved by the axial compression of the overall arrangement. The components 250, 270, 240 can be secured in a tight fit with negligible play because the axial engagement of the nozzle cap 230 and the housing 240 means that a large amount of torque can be applied to each component requiring disassembly to overcome the adhesive forces of the dried spray material. This also means that standard spanners can be used for disassembly of the threadably engaged parts 220, 230, 240 rather than an arbor press or other specialist disassembly device. Lands or flats 249*a* through 249*c* are provided for engagement by a spanner.

The upper end of the housing wall 234 slopes downwardly toward an opening 235 in the housing wall 234, the opening 235 being for the purpose of registration with the mouth 253 of the swirl chamber 250. The inclination downward of the upper edges 287 of the wall 234 protect the edges from damage and wear to which the upper opening 286 of the housing is exposed with the entry and removal of the wear parts 250, 270. The retaining edge 245 extends substantially around the upper edge 287 for about 180 to 270 degrees. The arm 237 is sufficiently resiliently deflectable to permit the entry of the wear parts into the housing by manual force, although a special tool 160 is required to remove the wear parts 250, 270 from the housing as described with reference to FIGS. 8*a* and 8*b*.

Figure 11:
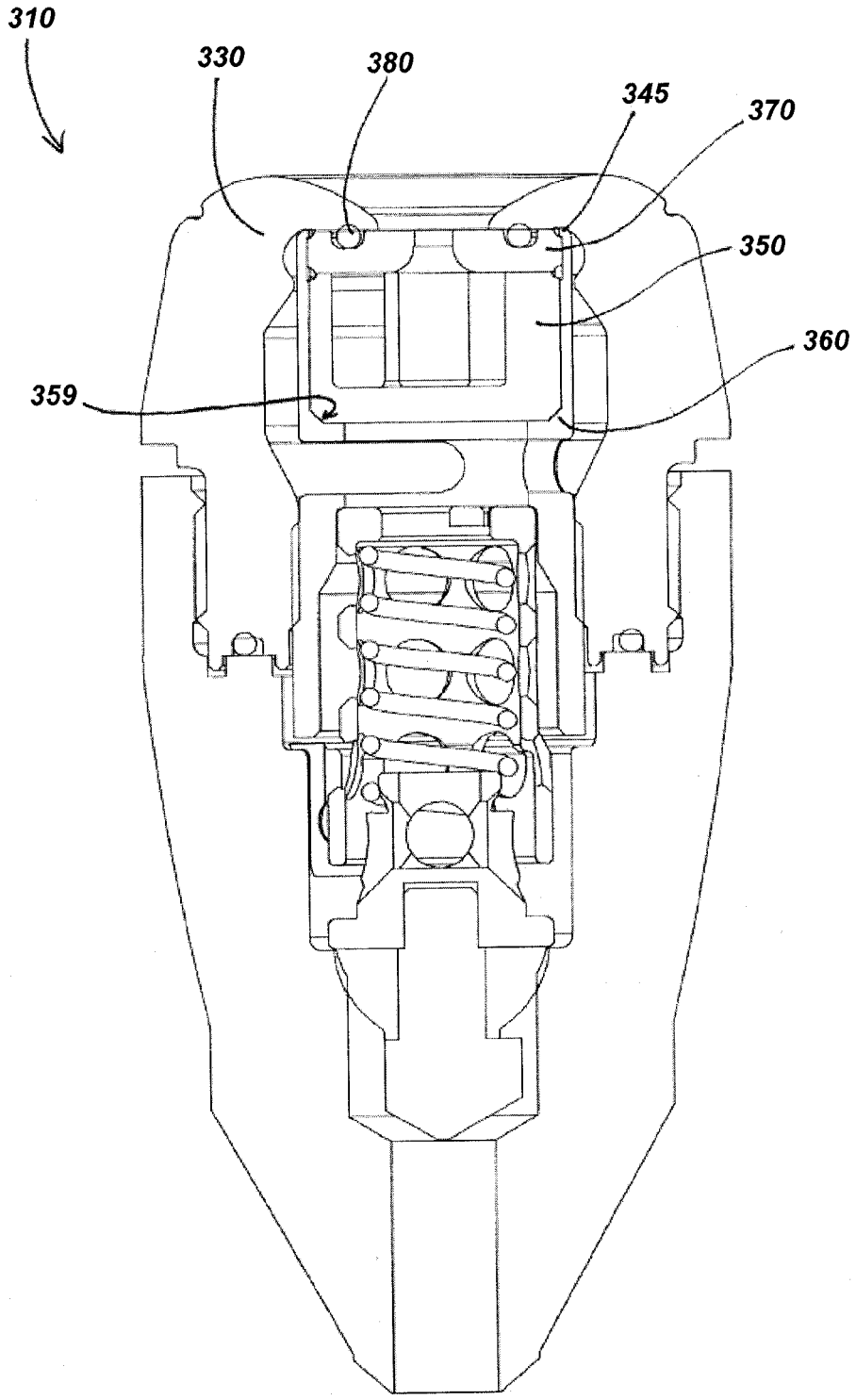
FIG. 11 is a cross-sectional view of a spray nozzle assembly according to a fourth embodiment of the invention.

In FIG. 11, there is shown a spray nozzle assembly similar to that shown in FIGS. 9*a* and 9*b*, but showing the respective taper lower periphery 359 of a swirl chamber 350 that cooperates with a corresponding and parallel internal annular angled corner forming a seat 360 in the internal wall surface of the housing 340. This enables a multi-stage procedure for achieving concentricity and axial alignment of the wear parts 350, 370 in which the wear parts may be eccentrically aligned once initially inserted into the housing 340, the housing 340 comprising claws 345 that grip the upper chamfered edge 373 of an orifice disc 370. However, on application of axial compressive force occasioned by the threaded engagement of the housing 340 in a nozzle cap 330, an O-ring 380 in the orifice disc 370 symmetrically bears down of the orifice disc 370 and forces the self-alignment of the wear part 350 by the operation of the cooperation of the angled annular surfaces 359, 360.

"Comprising": Throughout the specification and claims, the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise.

Orientational Terms: Orientational terms used in the specification and claims such as vertical, horizontal, top, bottom, upper and lower are to be interpreted as relational and are based on the premise that the component, item, article, apparatus, device or instrument will usually be considered in a particular orientation, typically with the nozzle cap downstream and the lance adapter upstream.

While we have in this specification described one general form of a spray nozzle and one particular arrangement of the nozzle with a check valve, it will be understood that other spray nozzle forms, which operate in the same manner as that described, can readily be utilized in the invention.

All such modifications and applications are deemed to be within the spirit and scope of the invention. It will be appreciated by those skilled in the art that many modifications and variations may be made to the embodiments described herein without departing from the spirit and scope of the invention.

What is claimed is:

1. A wear part adapted for use in a high-pressure spray nozzle assembly for spray drying, the wear part comprising:

at least one wear component, the wear component comprising an orifice disc comprising a hard and abrasion-resistant material comprising tungsten carbide, the at least one wear component defining an upper seal groove around a central aperture on an upper face of the wear part, the upper seal groove adapted to receive an axially compressible seal.

2. The wear part of claim 1, further comprising a housing comprising a resilient material to protect the wear component.

3. The wear part of claim 2, wherein the housing encases the wear component.

4. The wear part of claim 1, wherein the upper seal groove comprises a concentric groove around a periphery of the upper face of the wear component.

5. The wear part of claim 1, wherein lower side walls of the wear component are beveled or radiused.

6. The wear part of claim 1, further comprising a wear component comprising a swirl chamber adjacent and axially aligned with the orifice disc, wherein the swirl chamber comprises a key to prevent axial rotation of the swirl chamber in a nozzle chamber.

7. The wear part of claim 6, wherein the key defines at least one flat side wall of the swirl chamber.

8. The wear part of claim 6, wherein the key comprises at least one longitudinal groove.

9. The wear part of claim 1, wherein the wear part comprises a concentric location taper around at least a part of the periphery of the bottom edge of the wear part.

10. The wear part of claim 9, wherein the taper is adapted to cooperate with at least one complementary tapered internal surface of a nozzle chamber, wherein the wear part is adapted to be concentrically located in the nozzle chamber without a longitudinally aligned feature that extends substantially the full axial length of the wear part.

11. The wear part of claim 6, wherein the swirl chamber defines an opening.

12. The wear part of claim 11, wherein the swirl chamber is adapted to be retained in registration with a corresponding flow path of a nozzle chamber by interaction of the key and a structure complementary to the key in the nozzle chamber.

13. The wear part of claim 12, wherein the key is a longitudinally aligned key that extends along at least a part of the length of the side wall of the swirl chamber to prevent the swirl chamber from rotating in the nozzle chamber.

14. The wear part of claim 1, wherein the upper seal groove has a depth that allows an O-ring seal to sit partially above the upper face.

15. The wear part of claim 1, wherein the at least one wear component further comprises a swirl chamber.

16. A nozzle assembly comprising the wear part of claim 1.

17. The wear part of claim 1, wherein the hard and abrasion-resistant material further comprises iron-carbon steel.

18. The wear part of claim 1, wherein the hard and abrasion-resistant material further comprises stainless steel.

19. A wear part assembly for use in high pressure spray drying equipment comprising:

a protective shell comprising a resilient material defining a chamber and a key surface on an inner surface of the chamber;

a swirl chamber comprising a hard abrasion resistant material, the swirl chamber disposed within the chamber of the protective shell, the swirl chamber defining a complimentary key surface on an outer surface of the swirl chamber, the complimentary key surface extending to substantially the full height of the outer surface of the swirl chamber;

an orifice disc comprising a hard abrasion resistant material, the orifice disc disposed within the chamber of the protective shell; and an annular seal at least partially disposed within an annular groove on an upper face of the orifice disc.

20. The wear part assembly of claim 19, wherein the protective shell further comprises a protrusion extending radially inward, the protrusion configured to deflect radially outward when the swirl chamber and orifice disc are inserted into the chamber, and the protrusion configured to trap the orifice disc in place after the orifice disc and the swirl chamber are inserted into the chamber.

* * * * *